US012016480B2

(12) United States Patent
Tsao

(10) Patent No.: US 12,016,480 B2
(45) Date of Patent: Jun. 25, 2024

(54) CREATIVE ASSEMBLY MODEL STRUCTURE

(71) Applicant: Chung-Piao Tsao, Taipei (TW)

(72) Inventor: Chung-Piao Tsao, Taipei (TW)

( * ) Notice: Subject to any disclaimer, the term of this patent is extended or adjusted under 35 U.S.C. 154(b) by 34 days.

(21) Appl. No.: 17/936,008

(22) Filed: Sep. 28, 2022

(65) Prior Publication Data

US 2024/0099493 A1 Mar. 28, 2024

(51) Int. Cl.
*A47G 33/06* (2006.01)

(52) U.S. Cl.
CPC ..... *A47G 33/06* (2013.01)

(58) Field of Classification Search
CPC .... A47G 33/06; A63H 33/16; A63F 2001/025
See application file for complete search history.

(56) References Cited

U.S. PATENT DOCUMENTS

| | | | | |
|---|---|---|---|---|
| 2,129,563 A * | 9/1938 | Bublitz | A47G 33/06 | D11/118 |
| 4,429,486 A * | 2/1984 | Bjornstad | A63H 33/06 | 229/198.2 |
| 4,739,886 A * | 4/1988 | Seaberg | A47F 7/02 | 211/85.2 |
| 2011/0073737 A1* | 3/2011 | Lin | A47G 33/12 | 248/346.03 |

* cited by examiner

*Primary Examiner* — Kim S. Horger
(74) *Attorney, Agent, or Firm* — Leong C. Lei

(57) ABSTRACT

A creative assembly model structure is disclosed. The creative assembly model structure comprises a base and two modeling bodies, wherein a top surface of the base includes a plurality of first insertion slots to insert the two modeling bodies; the lower end of each of the two modeling bodies includes two first protruding parts to be inserted into the plurality of first insertion slots, the central position of each of the two modeling bodies includes at least one fitting part to assemble the two modeling bodies with each other, each of the two modeling bodies has a left-right symmetrical shape to facilitate folding in half, and each of the modeling bodies includes a plurality of modeling holes and a slit configured below the plurality of modeling holes to hang ornaments therein.

8 Claims, 15 Drawing Sheets

CREATIVE ASSEMBLY MODEL STRUCTURE

BACKGROUND OF THE INVENTION

1. Field of the Invention

The present invention generally relates to a model structure, in particular to a paper-made creative assembly model structure which may be easily assembled.

2. Description of the Related Art

During all kinds of festivals such as Spring Festival, Mid-Autumn Festival, Christmas or friends' birthdays, it is indispensable to distribute various gifts. In order to hand out creative and DIY gifts, people often look for gifts that can be easily completed and within reasonable price. The most common gifts on the market in this category are paper-made models. Since such gifts have the advantage of being flat and easy to carry, while able to be assembled via simple folding and assembling, such paper-made gifts have become a popular option for gifts.

However, the traditional paper-made gifts are usually fixed by setting interlocking slits, which can be assembled by fitting the upper and lower parts together. For those who are less skilled in handicrafts, it may be easy to damage the interlocking slits during assembly, resulting in the structure of the paper-made gifts to be relatively weak after assembly, or simply unable to complete the assembly. In addition, for the paper-made gift with a long structure, the interlocking slits must be longer (or deeper) for the firmness of the finished product, and makes it easier to damage the parts when the slits are fitted with each other, and the disassembly also become relatively inconvenient, resulting in people who are less skilled in handicrafts often lack of interest when receiving paper-made gifts, and unable to enjoy DIY assembly.

In view of the foregoing, it is necessary to improve the assembly structure of paper-made gifts, so that people who are less skilled in handicraft can easily assemble and enjoy the fun of making gifts by themselves.

SUMMARY OF THE INVENTION

As such, the inventors aimed to provide a creative assembly model structure to tackle the deficiencies of the known technology based on years of experience in manufacturing, development and designing of related products, so as to promote the implementation and utilization of the industry.

The present invention provides a creative assembly model structure, which comprises a base and two modeling bodies. Wherein, a top surface of the base includes a plurality of first insertion slots, and each of the two modeling bodies includes two first protruding parts, at least one fitting part, a folding line, a plurality of modeling holes, and a slit configured below each of the plurality of modeling holes. Each of the two modeling bodies has a left-right symmetrical shape to facilitate folding in half.

The two first protruding parts of the modeling body are located at the lower end of the modeling body; the folding lines are respectively arranged along the center of the modeling body from an upper end to a lower end, so the modeling body appears symmetrical after folding left and right; the at least one fitting part of the modeling body is disposed along the folding line; and each of the plurality of modeling holes of the modeling body is located inside the modeling body.

When assembling the creative assembly model structure, start by folding the two modeling bodies in half along the folding line, so that the at least one fitting part expends to form a fitting protrusion and a fitting notch corresponding each other; then insert the two first protruding parts respectively provided at the lower ends of the two modeling bodies into the plurality of first insertion slots of the base for fixing; finally the fitting protrusions and the fitting notch that are formed by expending the two modeling bodies after being folded along the folding lines respectively, are fitted and fastened to each other (i.e. the fitting protrusion of one fitted to the fitting notch of the other) for fixing, and thus the assembly of the creative assembly model structure is completed.

The shape of the fitting parts may have different shapes, such as a semicircle, a triangle, a rectangle or a rhombus and the like, but not limited thereto. When the two modeling bodies are folded respectively, the fitting protrusions and the fitting notch having different shapes may be formed.

The plurality of modeling holes may be configured as openings with different shapes and sizes, and the slit configured below the modeling holes may be used to hang ornaments therein.

The two modeling bodies may be selected between different shapes according to different occasions. For example, when used as a Christmas paper-made gift, the modeling bodies can be made into the shape of a Christmas tree; or when used as a building model, the modeling bodies can be made into the shape of the Eiffel Tower, but not limited thereto.

In addition, the top surface of the base of the creative assembly model structure may further include a plurality of second insertion slots to insert a plurality of modeling parts for increased aesthetics. Each of the plurality of modeling parts also includes two second protruding parts, a folding line, a plurality of modeling holes, and a slit configured below each of the plurality of modeling holes. Each of the modeling parts also has a left-right symmetrical shape to facilitate folding in half.

The two second protruding parts of the modeling parts are located at the lower end of the modeling parts; the folding lines are respectively arranged along the center of the modeling parts from an upper end to a lower end, so the modeling parts appear symmetrical after folding left and right; and each of the plurality of modeling holes of the modeling parts is located inside the modeling parts.

When assembling the plurality of modeling parts, start by folding each modeling parts in half along the folding line; then insert the two protruding parts respectively provided at the lower ends of the plurality of modeling parts into the plurality of second insertion slots of the base for fixing, and thus the assembly of the plurality of modeling parts are completed.

The plurality of modeling parts also may be selected between different shapes according to different occasions. For example, when used as a Christmas paper-made gift, the plurality of modeling parts can be made into the shape of a Christmas tree; or when used as a building model, the plurality of modeling parts can be made into the shape of tourists, but not limited thereto.

Furthermore, the numbers of the plurality of modeling parts may be determined according to different occasions. For example, when used as a Christmas paper-made gift, the plurality of modeling parts can be used to occupy each and every second insertion slots of the base; or when used as a building model, one may choose to use only one of the modeling parts to be inserted into one of the plurality of second insertion slots of the base.

According to the creative assembly model structure developed by the inventor of the present invention, after inserting the modeling bodies and the modeling parts into the base, and fitting/fastening the fitting protrusions and the fitting notch of the two modeling bodies to each other, the assembly of may be easily completed. Therefore, the present invention may overcome the problems of conventional paper-made gifts where the parts being easily damaged when the slits are fitted with each other, and the inconvenience during disassembly, so people who are less skilled in handicrafts may also complete the assembly easily, and thus able to enjoy the fun of making gifts by themselves.

The technical features of the present invention will be described in detail below with specific embodiments in conjunction with the accompanying drawings, so that those with ordinary skill in the art can easily understand the purpose, technical features, and advantages of the present invention.

BRIEF DESCRIPTION OF THE DRAWINGS

In order to illustrate the technical solutions of the embodiments of the present invention more clearly, the following briefly introduces the accompanying drawings that need to be used in the description of the embodiments of the present invention. Obviously, the drawings described below only represent some embodiments of the present invention, and for those with ordinary skill in the art to which the present invention belongs, other embodiments can also be obtained according to these drawings.

DETAILED DESCRIPTION OF THE PREFERRED EMBODIMENTS

The technical content of the present invention will become apparent by the detailed description of the following embodiments and the illustration of related drawings. The purpose of the drawings is only for illustration and auxiliary instructions, and may not necessarily be the real proportion and precise configuration of the implementation of the present invention. Therefore, the proportion and relative configuration of the attached drawings should not be interpreted as or limiting the scope of the present invention in actual implementation.

Figure 1:
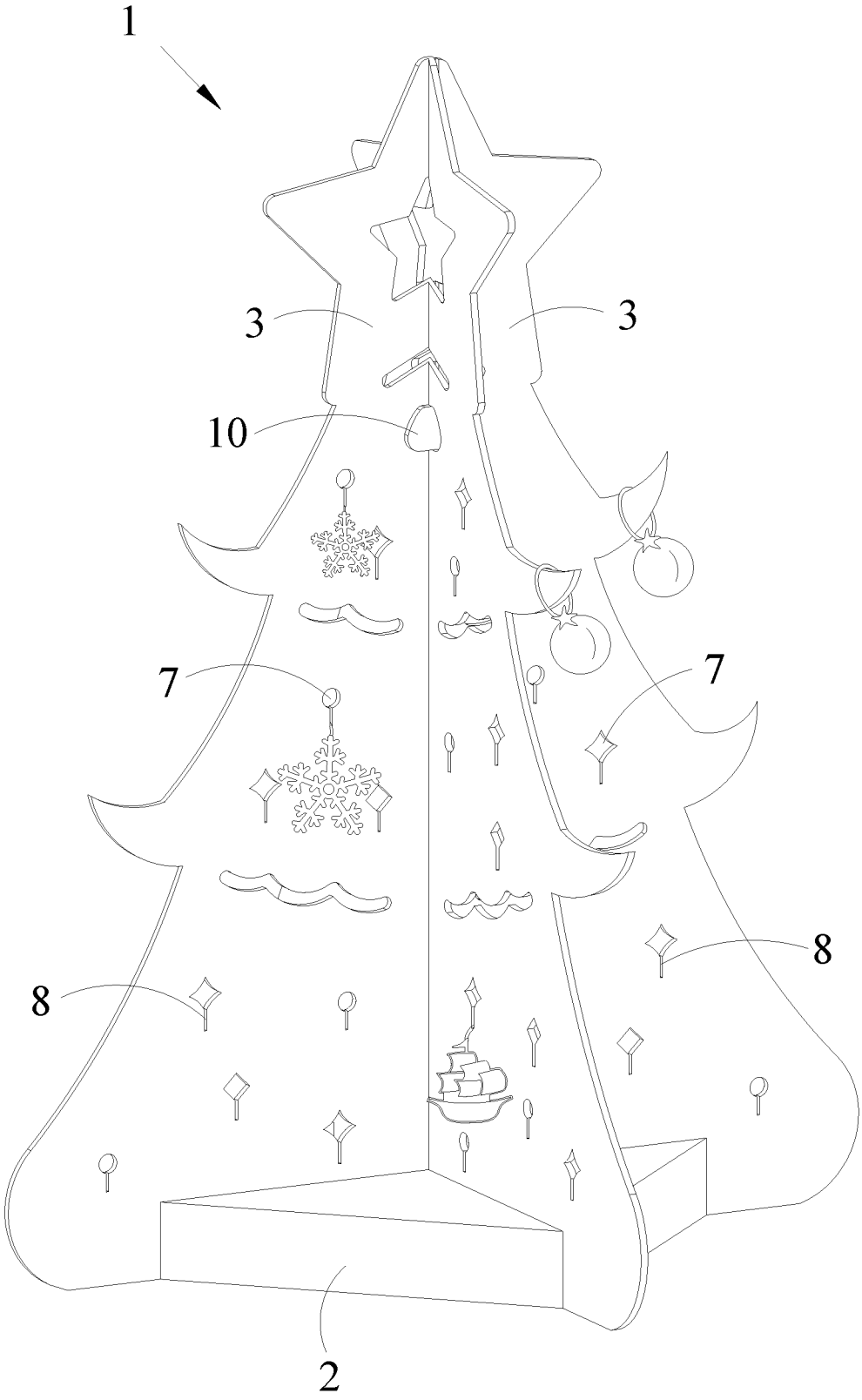
FIG. 1 is a schematic perspective view of a creative assembly model structure of the present invention.
Figure 2:
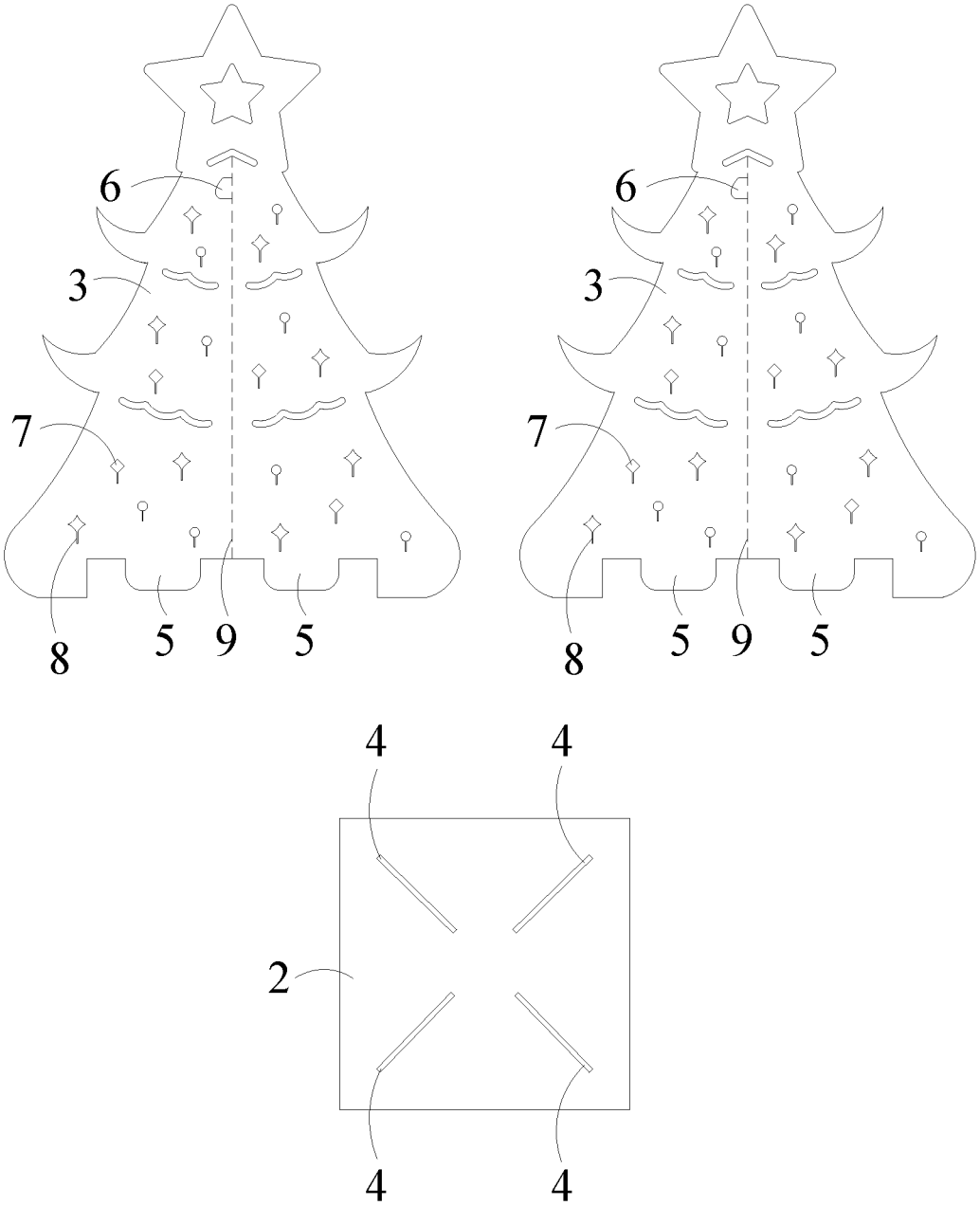
FIG. 2 is an exploded view of a creative assembly model structure of the present invention.

With reference to FIG. 1 and FIG. 2, wherein FIG. 1 is a schematic perspective view of a creative assembly model structure of the present invention, and FIG. 2 is an exploded view of a creative assembly model structure of the present invention. The creative assembly model structure 1 comprises a base 2 and two modeling bodies 3. Wherein, a top surface of the base 2 includes a plurality of first insertion slots 4, and each of the two modeling bodies 3 includes two first protruding parts 5, at least one fitting part 6 (one fitting part 6 as shown in the figure for instance), a folding line 9, a plurality of modeling holes 7, and a slit 8 configured below each of the plurality of modeling holes 7. Each of the modeling bodies 3 has a left-right symmetrical shape to facilitate folding in half.

The two first protruding parts 5 of the modeling body 3 are located at the lower end of the modeling body 3; the folding lines 9 are respectively arranged along the center of the modeling body 3 from an upper end to a lower end, so the modeling body 3 appears symmetrical after folding left and right; the at least one fitting part 6 of the modeling body 3 is disposed along the folding line 9; and each of the plurality of modeling holes 7 of the modeling body 3 is located inside the modeling body 3.

Figure 3:
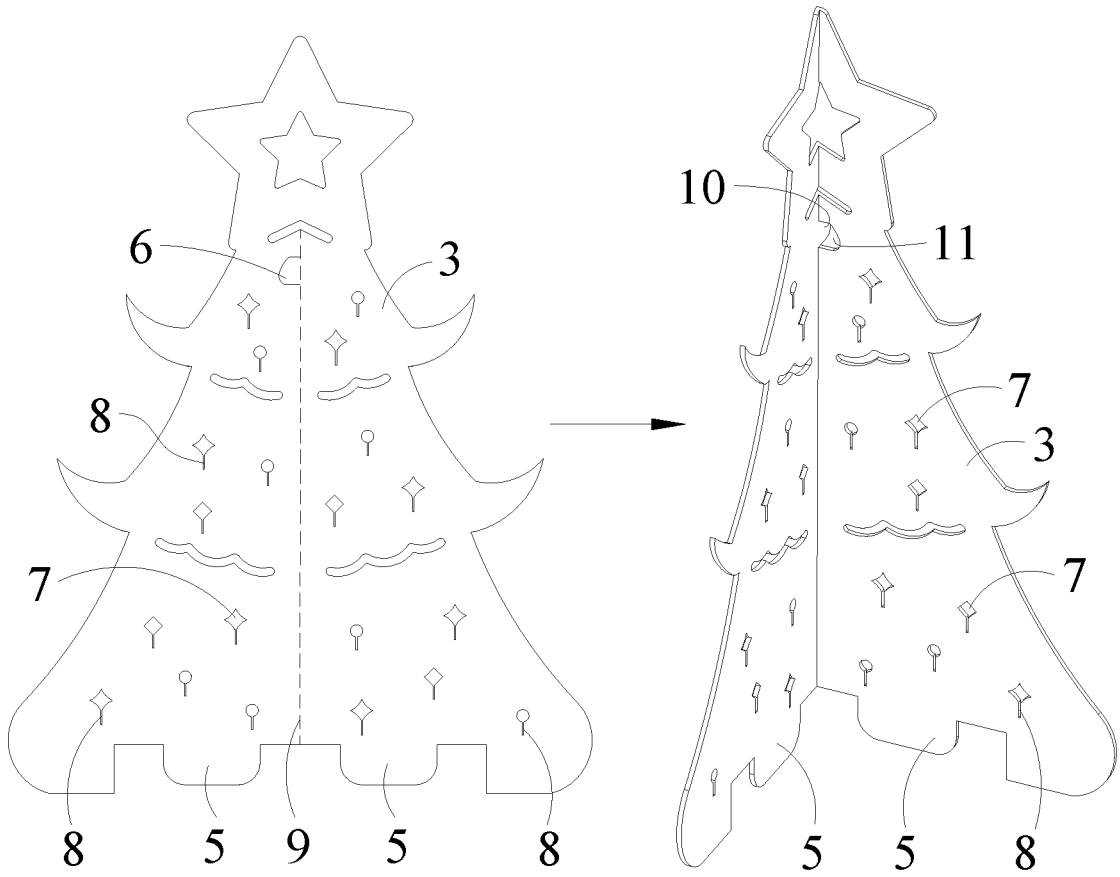
FIG. 3 is a schematic view of a creative assembly model structure of the present invention being folded.

With reference to FIG. 3, wherein FIG. 3 is a schematic view of a creative assembly model structure of the present invention being folded. After folding the two modeling bodies 3 in half along the folding line 9, the at least one fitting part 6 expends to form a fitting protrusion 10 and a fitting notch 11 corresponding each other. When assembling, the fitting protrusions 10 of one modeling body 3 and the fitting notch 11 of the other modeling body 3 are fitted and fastened to each other for fixing, and vice versa, so the two modeling bodies 3 may be easily fixed to each other.

Figure 4:
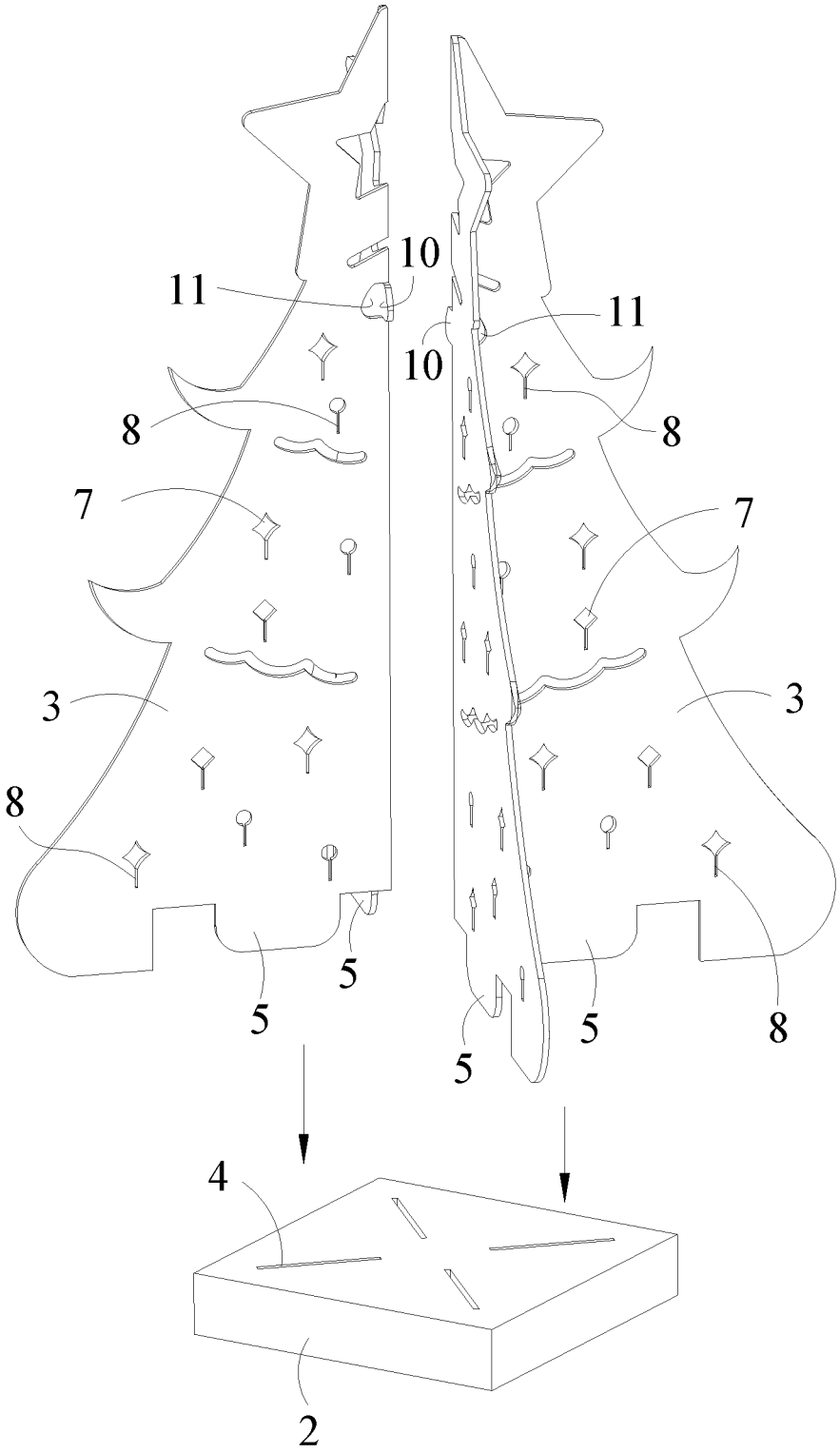
FIG. 4 and FIG. 5 are schematic views of a creative assembly model structure of the present invention being assembled.
Figure 5:
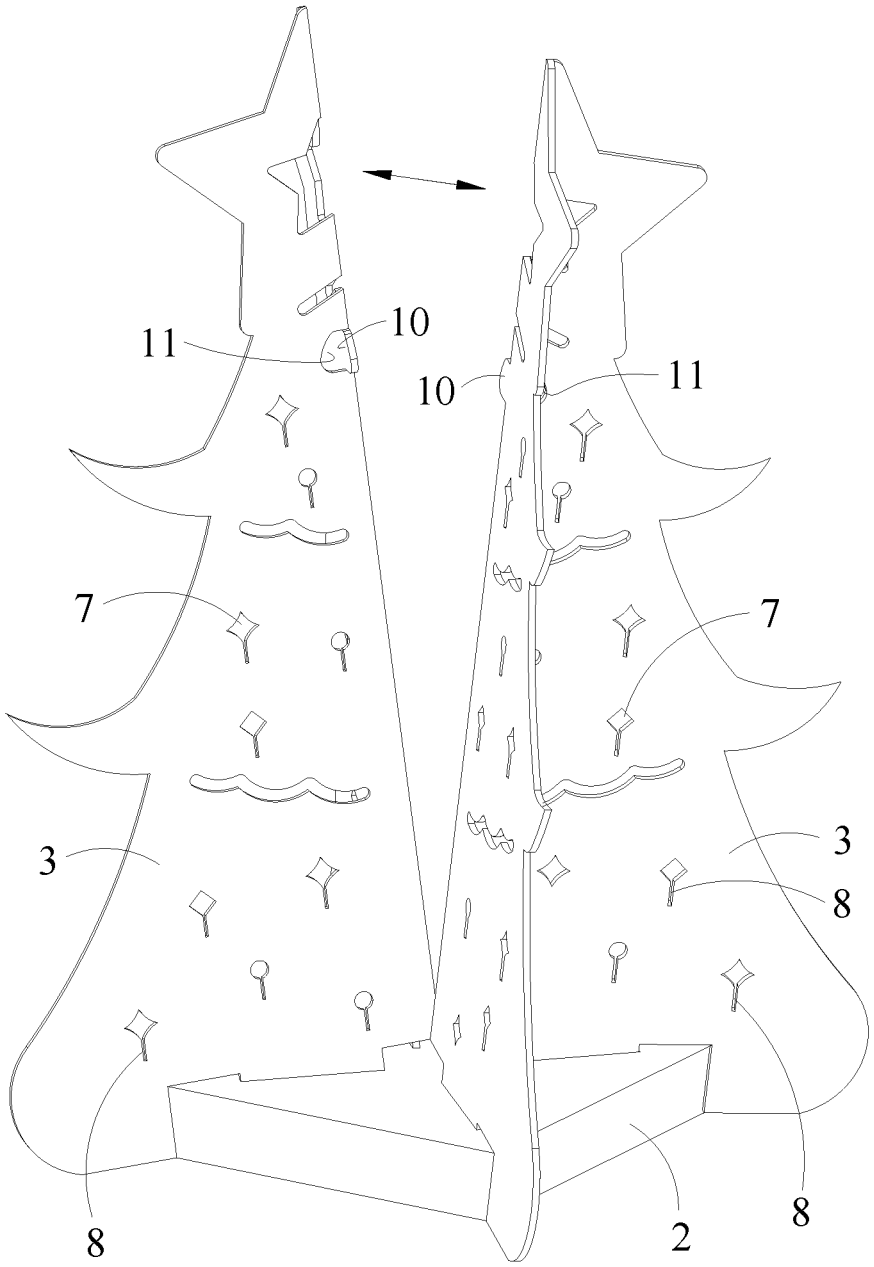

With reference to FIG. 4 and FIG. 5, wherein FIG. 4 and FIG. 5 are schematic views of a creative assembly model structure of the present invention being assembled. When assembling the creative assembly model structure 1, start by folding the two modeling bodies 3 in half along the folding line 9, so that the at least one fitting part 6 expends to form a fitting protrusion 10 and a fitting notch 11 corresponding each other; then insert the two first protruding parts 5 respectively provided at the lower ends of the two modeling bodies 3 into the plurality of first insertion slots 4 of the base 2 for fixing; finally the fitting protrusions 10 and the fitting notch 11 that are formed by expending the two modeling bodies 3 after being folded along the folding lines 9 respectively, are fitted and fastened to each other (i.e. the fitting protrusion 10 of one fitted to the fitting notch 11 of the other) for fixing, and thus the assembly of the creative assembly model structure 1 is completed.

The shape of the fitting parts 6 may have different shapes, such as a semicircle, a triangle, a rectangle or a rhombus and the like, but not limited thereto. When the two modeling bodies 3 are folded respectively, the fitting protrusions 10 and the fitting notch 11 having different shapes may be formed.

The plurality of modeling holes 7 on the modeling bodies 3 may be configured as openings with different shapes and sizes, and the slit 8 configured below the modeling holes 7 may be used to hang ornaments therein. The ornaments may be tied to a string, and the string may be fitted into the slit 8 to decorate the creative assembly model structure 1, or fitting small accessories into the slit 8, such as bracelets, rings or earrings to use the creative assembly model structure 1 as a style storage display stand.

Figure 6:
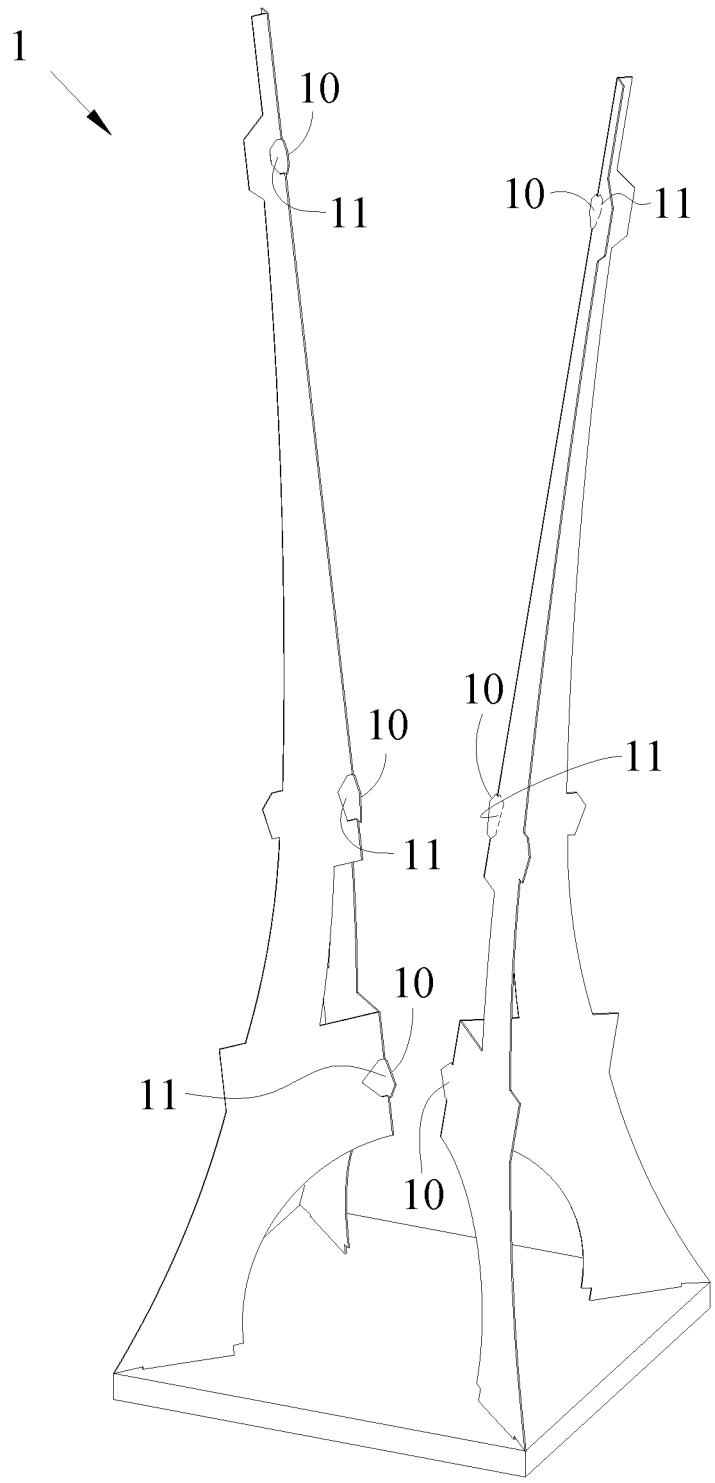
FIG. 6 and FIG. 7 are schematic views of another modeling body of a creative assembly model structure of the present invention.
Figure 7:
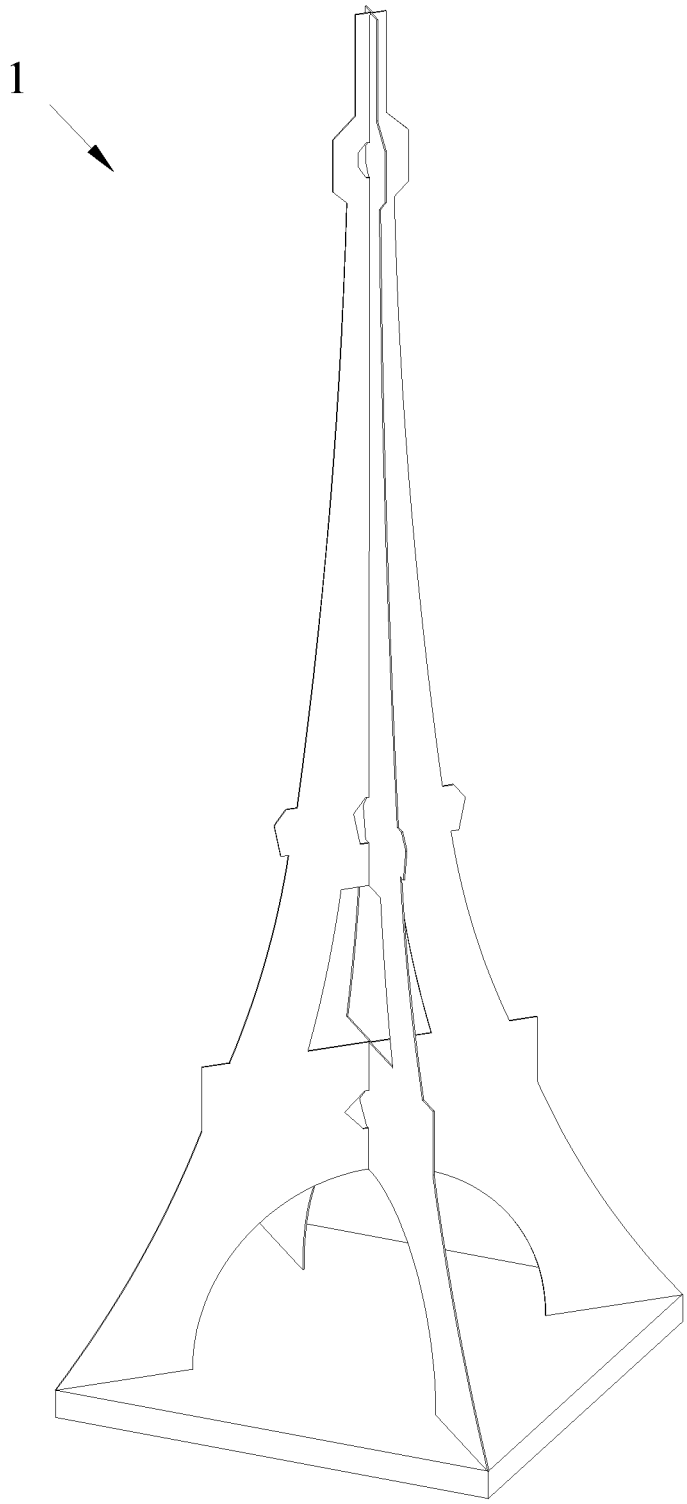

With reference to FIG. 6 and FIG. 7, wherein FIG. 6 and FIG. 7 are schematic views of another modeling body of a creative assembly model structure of the present invention.

The two modeling bodies 3 may be selected between different shapes according to different occasions. For example, when used as a Christmas paper-made gift, the modeling bodies 3 can be made into the shape of a Christmas tree; or when used as a building model, the modeling bodies 3 can be made into the shape of the Eiffel Tower (as shown in FIG. 6 and FIG. 7), but not limited thereto.

Preferably, the two modeling bodies 3 can be provided with at least one or more of the fitting parts 6 according to their corresponding shapes. With reference to FIG. 6, when the two modeling bodies 3 are shaped as the Eiffel Tower, three fitting parts 6 (the fitting parts 6 have been expanded into the fitting protrusion 10 and the fitting notch 11 in the figure) are provided to enhance the structure.

Figure 8:
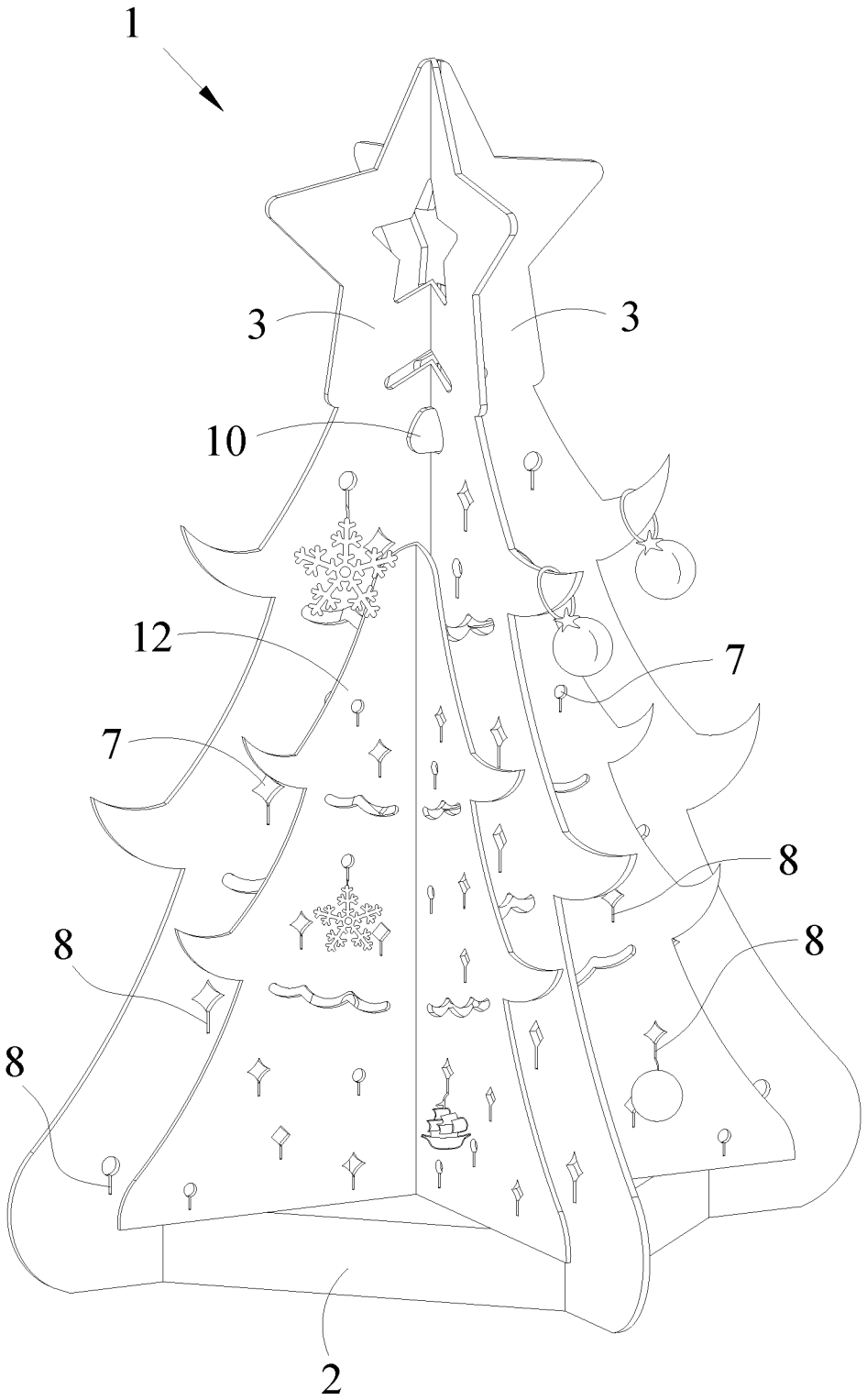
FIG. 8 is a schematic view of a creative assembly model structure of the present invention with the addition of modeling parts.
Figure 9:
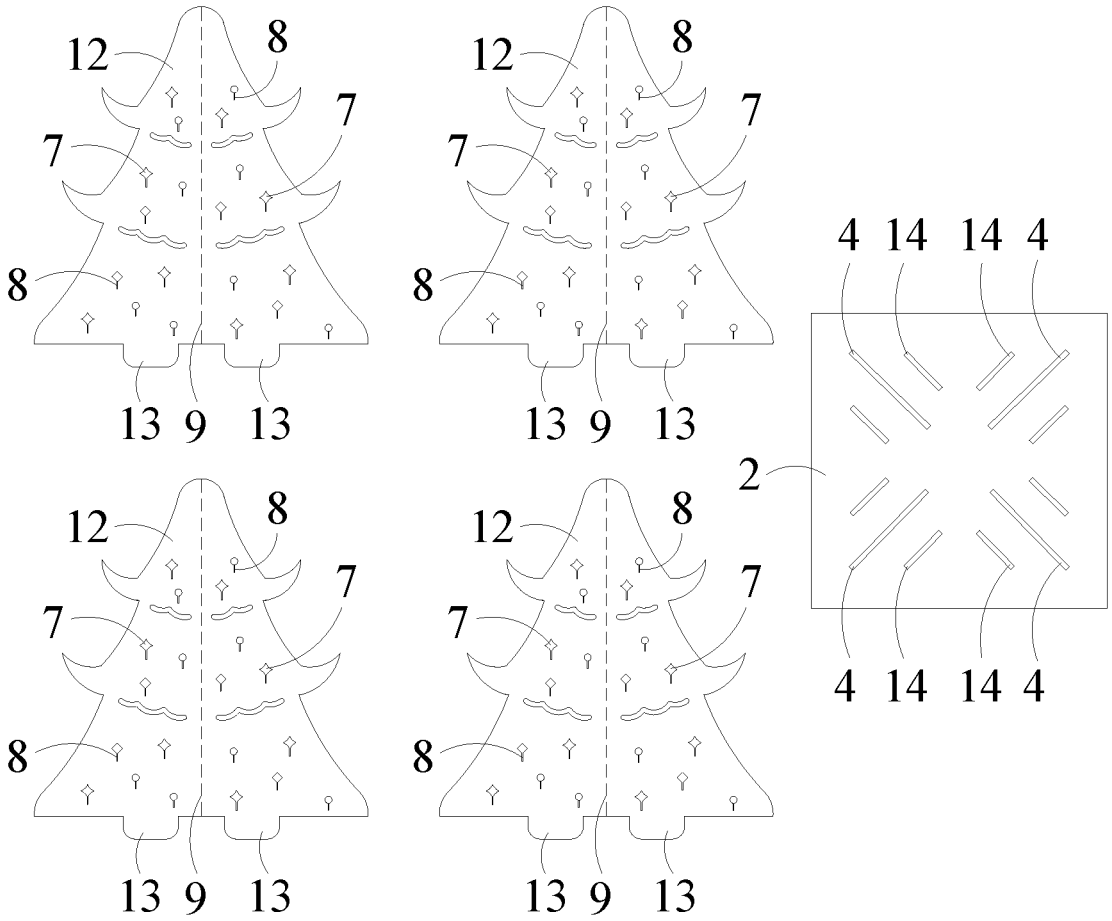
FIG. 9 is a schematic view of the modeling parts and the corresponding base of a creative assembly model structure of the present invention.

With reference to FIG. 8 and FIG. 9, wherein FIG. 8 is a schematic view of a creative assembly model structure of the present invention with the addition of modeling parts, and FIG. 9 is a schematic view of the modeling parts and the corresponding base of a creative assembly model structure of the present invention. The top surface of the base 2 of the creative assembly model structure 1 may further include a plurality of second insertion slots 14 to insert a plurality of modeling parts 12 for increased aesthetics. Each of the plurality of modeling parts 12 also includes two second protruding parts 13, a folding line 9, a plurality of modeling holes 7, and a slit 8 configured below each of the plurality of modeling holes 7. Each of the modeling parts 12 also has a left-right symmetrical shape to facilitate folding in half.

Figure 10:
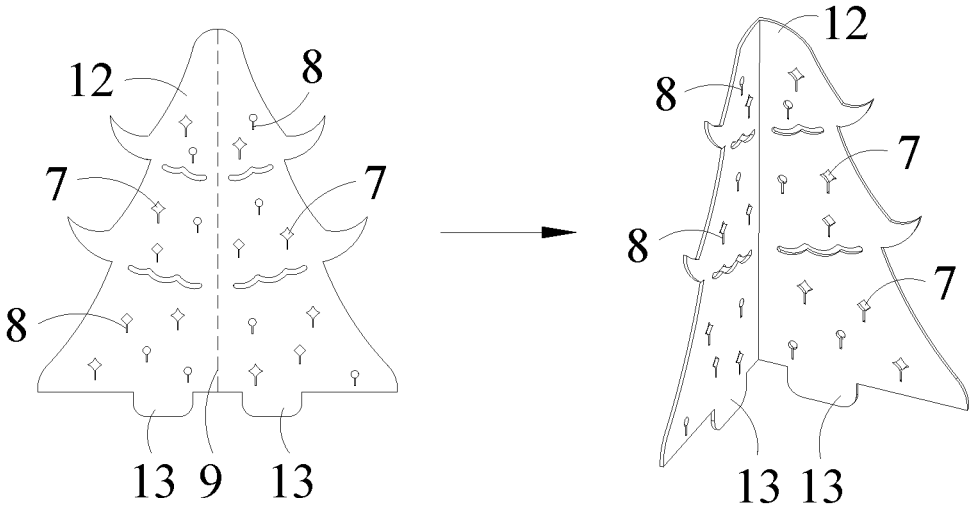
FIG. 10 is a schematic view of the modeling parts of a creative assembly model structure of the present invention being folded.

With reference to FIG. 10, wherein FIG. 10 is a schematic view of the modeling parts of a creative assembly model structure of the present invention being folded. The two second protruding parts 13 of the modeling parts 12 are located at the lower end of the modeling parts 12; the folding lines 9 are respectively arranged along the center of the modeling parts 12 from an upper end to a lower end, so the modeling parts 12 appear symmetrical after folding left and right; and each of the plurality of modeling holes 7 of the modeling parts 12 is located inside the modeling parts 12.

Figure 11:
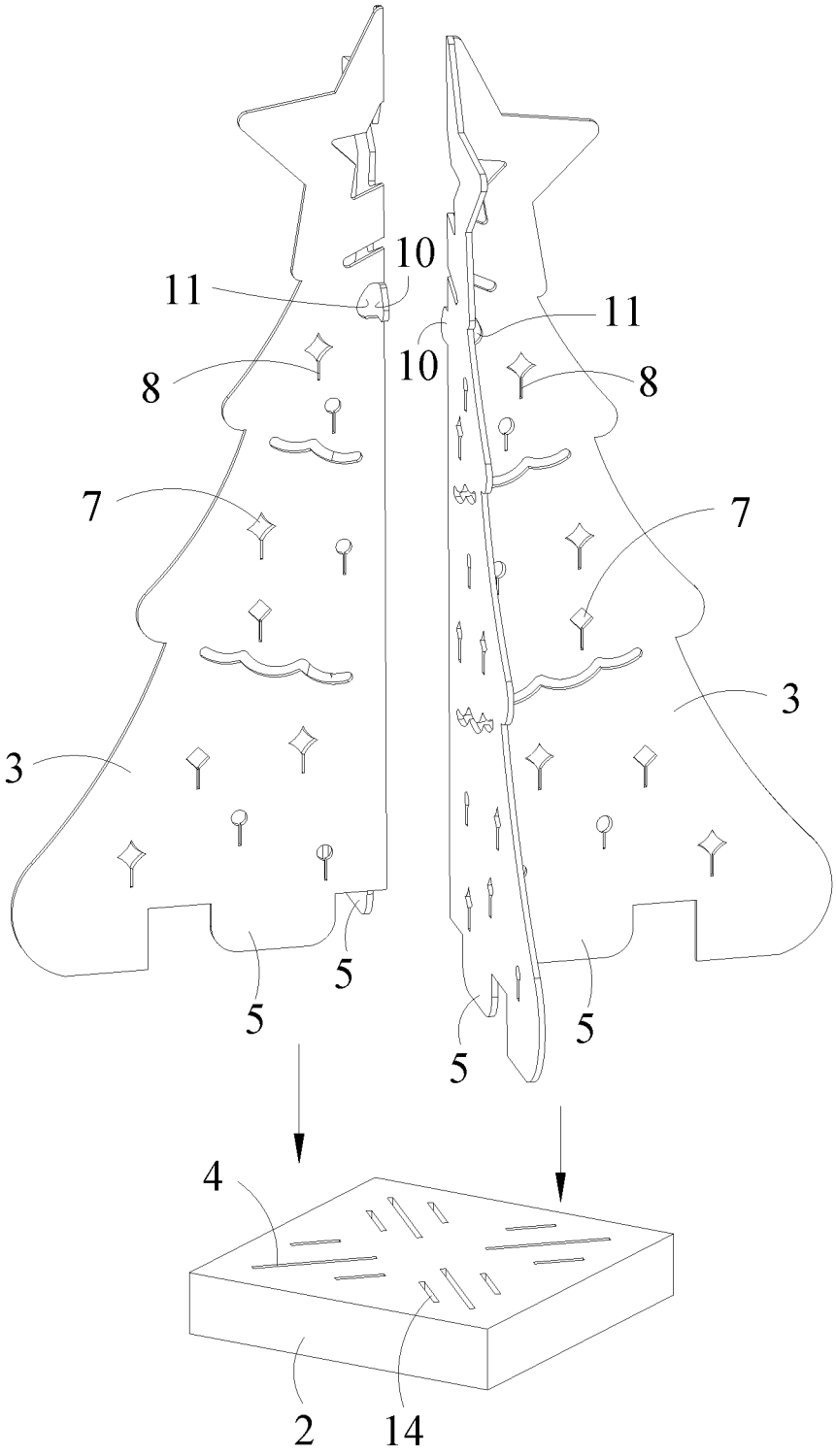
FIGS. 11~13 are schematic views of a creative assembly model structure and modeling parts of the present invention being assembled.
Figure 12:
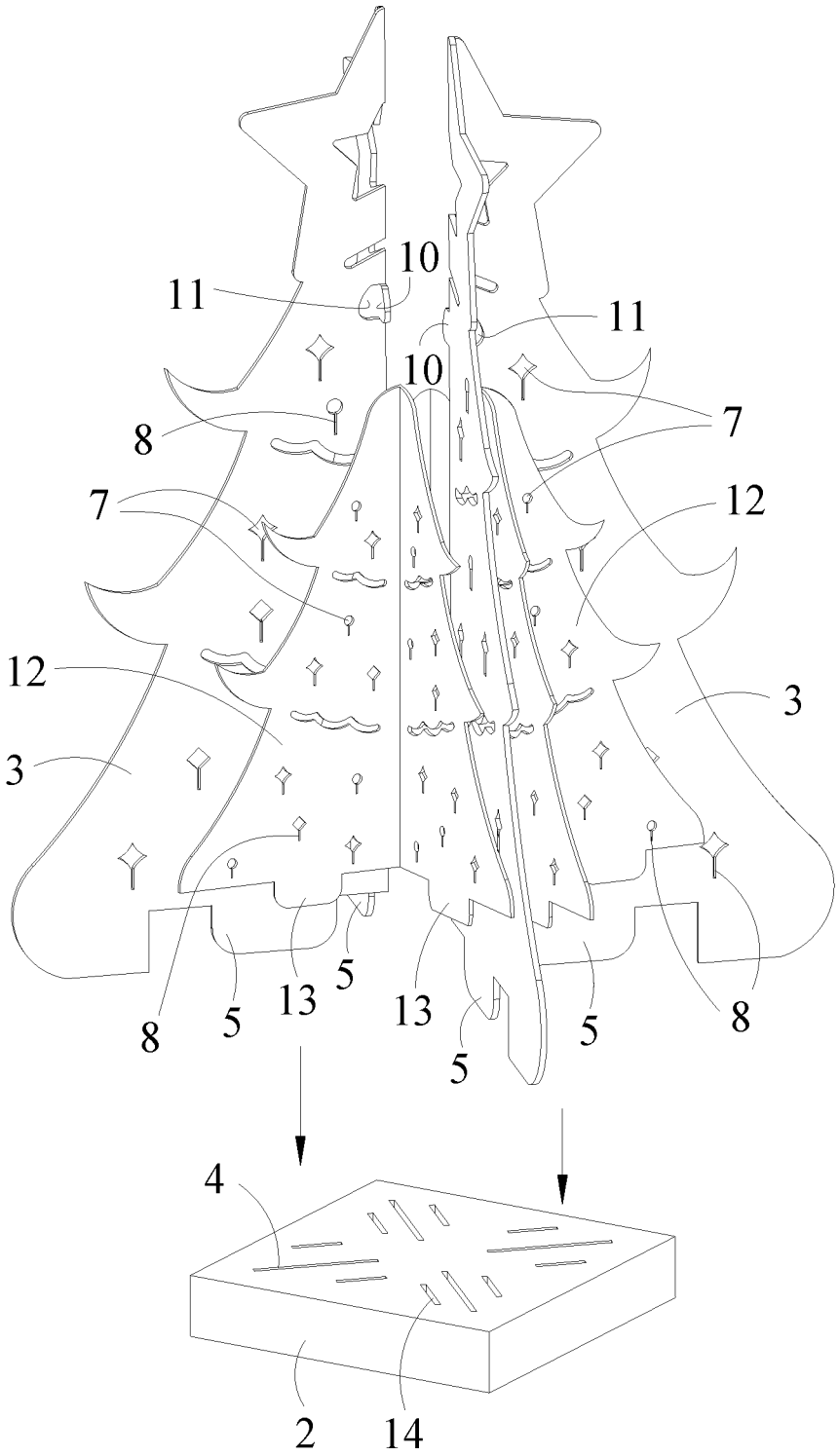
Figure 13:
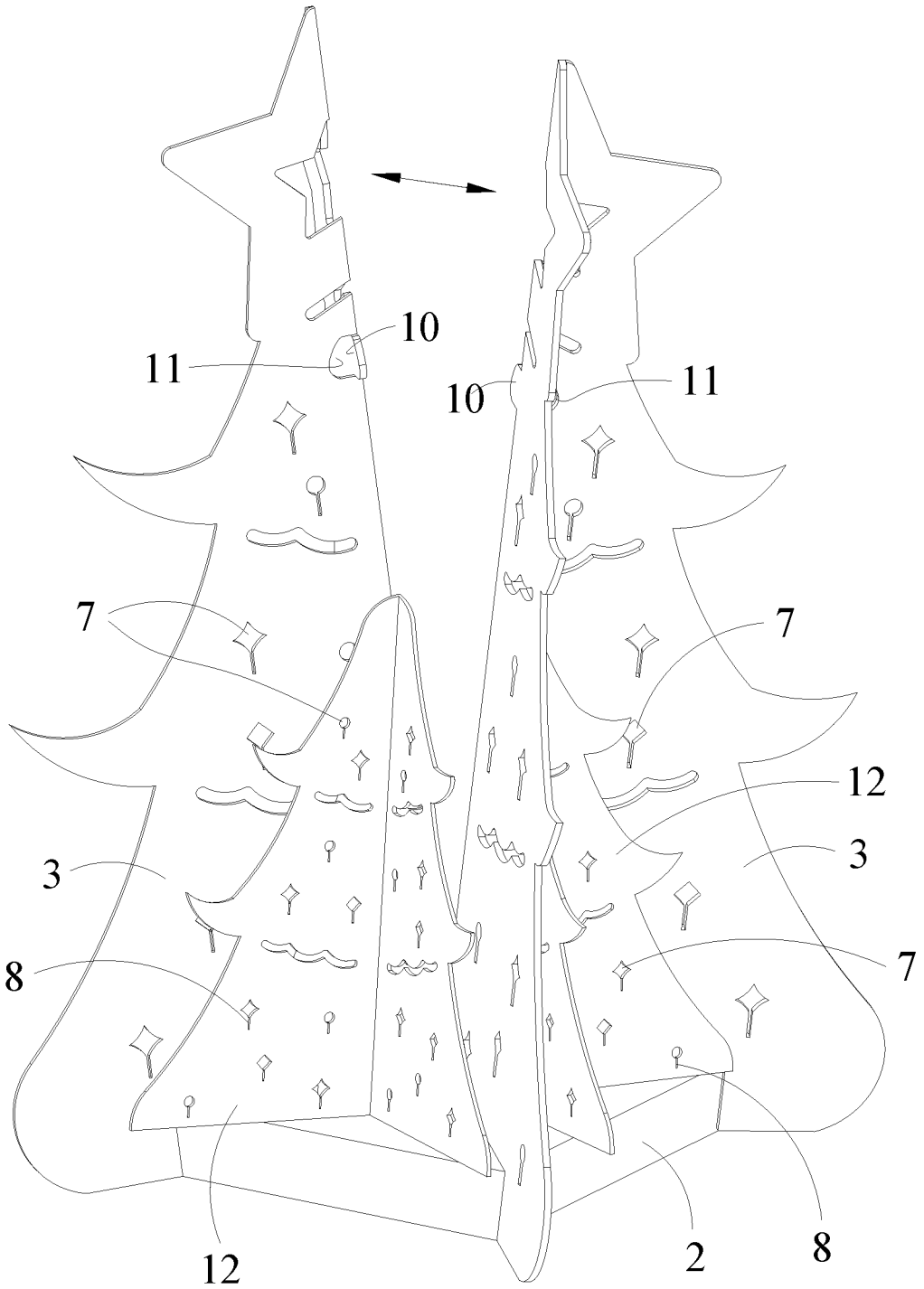

With reference to FIGS. 11~13, wherein FIGS. 11~13 are schematic views of a creative assembly model structure and modeling parts of the present invention being assembled. The method of assembling the modeling bodies 3 are the same as described above. On the other hand, when assembling the plurality of modeling parts 12, start by folding each modeling parts 12 in half along the respective folding line 9; then insert the two protruding parts 12 respectively provided at the lower ends of the plurality of modeling parts 12 into the plurality of second insertion slots 14 of the base 2 for fixing, and thus the assembly of the plurality of modeling parts 12 are completed.

Figure 14:
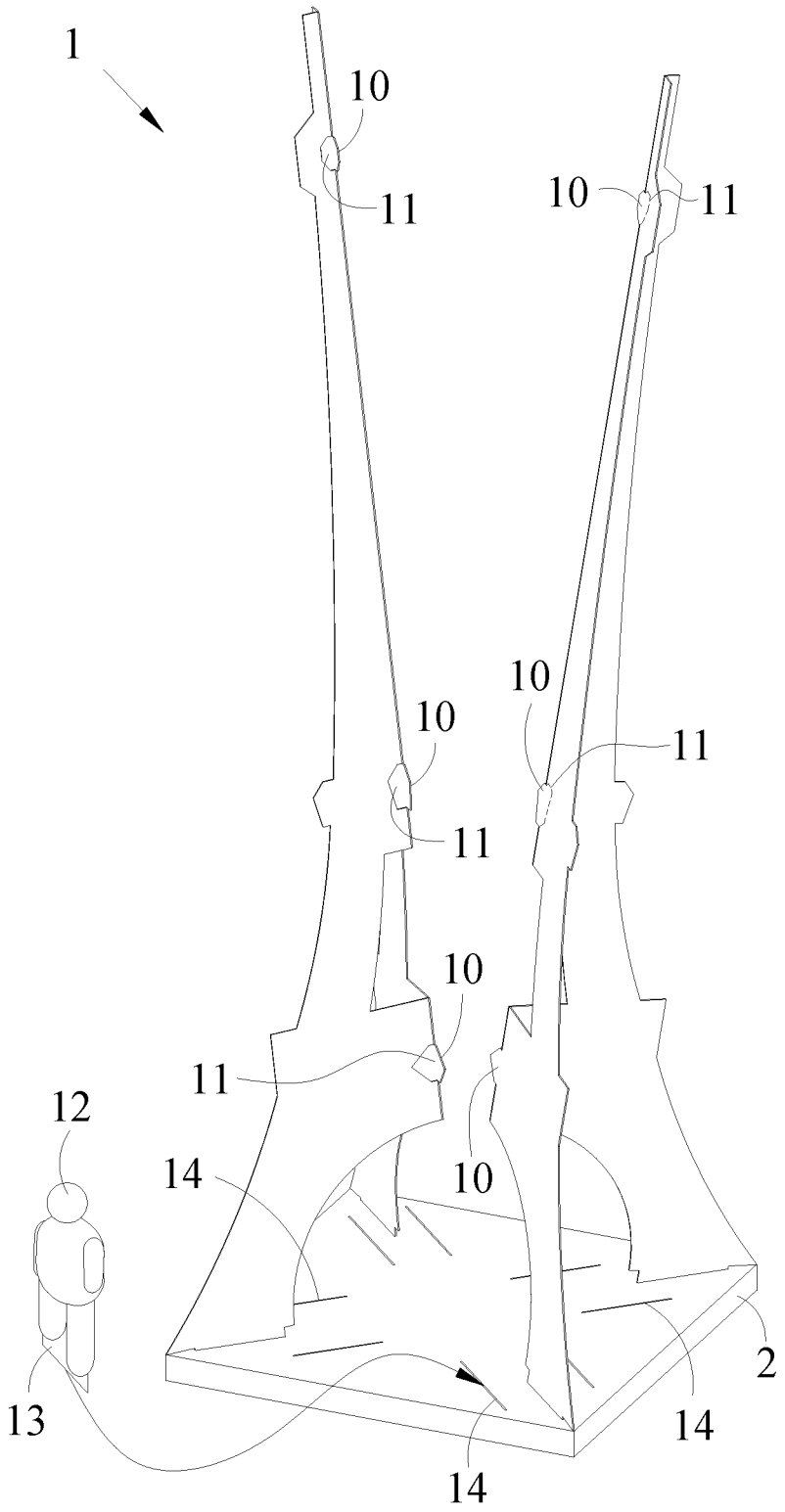
FIG. 14 and FIG. 15 are schematic views of another modeling body and modeling parts of a creative assembly model structure of the present invention.
Figure 15:
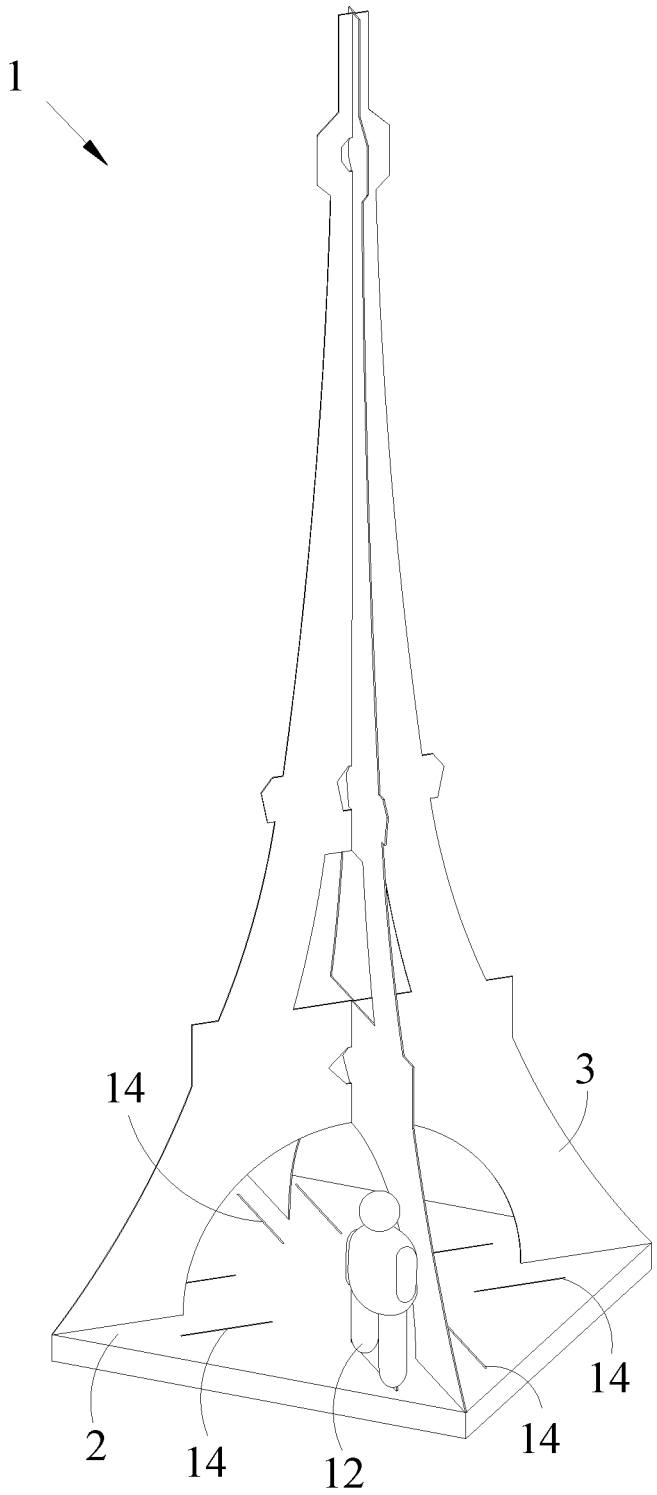

With reference to FIG. 14 and FIG. 15, wherein FIG. 14 and FIG. 15 are schematic views of another modeling body and modeling parts of a creative assembly model structure of the present invention. The plurality of modeling parts 12 also may be selected between different shapes according to different occasions. For example, when used as a Christmas paper-made gift, the plurality of modeling parts 12 can be made into the shape of a Christmas tree (as shown in FIG. 8 or FIG. 9); or when used as a building model, the plurality of modeling parts 12 can be made into the shape of tourists (as shown in FIG. 14 or FIG. 15), but not limited thereto.

Furthermore, the numbers of the plurality of modeling parts 12 may be determined according to different occasions. For example, when used as a Christmas paper-made gift, the plurality of modeling parts 12 can be used to occupy each and every second insertion slots 14 of the base 2; or when used as a building model, one may choose to use only one of the modeling parts 12 to be inserted into one of the plurality of second insertion slots 14 of the base 2.

The above description is only exemplary, rather than limiting. Any equivalent modifications or changes that do not depart from the spirit and scope of the present invention should be included in the scope of the appended claims.

What is claimed is:

1. A creative assembly model structure, comprising:

a base, wherein a top surface of the base includes a plurality of first insertion slots; and two modeling bodies, wherein each of the two modeling bodies includes two first protruding parts, at least one fitting part, a folding line, and a plurality of modeling holes, wherein the two first protruding parts of the modeling body are located at the lower end of the modeling body;

the folding lines of the modeling body are respectively arranged along the center of the modeling body from an upper end to a lower end;

the at least one fitting part of the modeling body is disposed along the folding line;

each of the plurality of modeling holes of the modeling body includes a slit configured below the plurality of modeling holes; and each of the plurality of modeling holes of the modeling body is located inside the modeling body, wherein after the two modeling bodies are respectively folded left and right along the folding line, the at least one fitting part of each of the two modeling bodies expands to form a fitting protrusion and a fitting notch corresponding in shape and size to each other, and the fitting protrusion of one modeling body is fitted to the fitting notch of the other modeling body to fix the two modeling bodies to each other along the folding lines of the two modeling bodies; and wherein the two modeling bodies are identical to each other and the two identical modeling bodies are joined to each other by having the fitting protrusions and the fitting notches fit to each other to have the folding lines of the two modeling bodies contacting each other so as to form a configuration having four wings, wherein each of the two modeling bodies has two halves defined by the folding line and the two modeling bodies include four halves that respectively define the four wings of the configuration.

2. The creative assembly model structure of claim 1, wherein each of the two modeling bodies has a left-right symmetrical shape.

3. The creative assembly model structure of claim 1, wherein a shape of the at least one fitting part being a semicircle, a triangle, a rectangle or a rhombus, when the two modeling bodies are folded respectively, the at least one fitting part forms the fitting protrusion and the fitting notch corresponding to the shape.

4. The creative assembly model structure of claim 1, wherein the plurality of modeling holes being openings with different shapes and sizes.

5. The creative assembly model structure of claim 1, wherein the top surface of the base further includes a plurality of second insertion slots to insert a plurality of modeling parts.

6. The creative assembly model structure of claim 5, wherein each of the plurality of modeling parts includes two second protruding parts, a folding line, and a plurality of modeling holes, wherein the two second protruding parts of the modeling parts are located at the lower end of the modeling parts;

the folding line of the modeling parts are respectively arranged along the center of the modeling parts from an upper end to a lower end;

each of the plurality of modeling holes of the modeling parts includes a slit configured below the plurality of modeling holes; and each of the plurality of modeling holes of the modeling parts is located inside the modeling parts.

7. The creative assembly model structure of claim 6, wherein each of the plurality of modeling parts has a left-right symmetrical shape.

8. The creative assembly model structure of claim 6, wherein the plurality of modeling holes of the plurality of modeling parts being openings with different shapes and sizes.

* * * * *